US007942665B2

(12) United States Patent
Kotani

(10) Patent No.: US 7,942,665 B2
(45) Date of Patent: May 17, 2011

(54) IGNITER

(75) Inventor: Hiroaki Kotani, Tokyo (JP)

(73) Assignee: Iwatani Corporation, Osaka (JP)

( * ) Notice: Subject to any disclaimer, the term of this patent is extended or adjusted under 35 U.S.C. 154(b) by 302 days.

(21) Appl. No.: 12/212,108

(22) Filed: Sep. 17, 2008

(65) Prior Publication Data

US 2010/0021854 A1 Jan. 28, 2010

(30) Foreign Application Priority Data

Jul. 24, 2008 (JP) ..... 2008-191219

(51) Int. Cl.
*F23D 11/36* (2006.01)

(52) U.S. Cl. ..... 431/153; 126/39 E; 239/349; 239/359; 42/70.01

(58) Field of Classification Search ..... 126/39 E; 239/349, 359; 42/70.01; 431/153
See application file for complete search history.

(56) References Cited

U.S. PATENT DOCUMENTS

| | | | | |
|---|---|---|---|---|
| 3,713,242 | A * | 1/1973 | Seifried | 42/70.06 |
| 4,276,461 | A * | 6/1981 | Piber | 200/329 |
| 5,125,829 | A * | 6/1992 | McDonough et al. | 431/255 |
| 5,207,129 | A * | 5/1993 | Fossella | 81/63.2 |
| 5,215,458 | A * | 6/1993 | Cirami | 431/277 |
| 5,305,670 | A * | 4/1994 | Fossella et al. | 81/63.2 |
| 5,414,793 | A * | 5/1995 | Morikawa | 388/824 |
| 5,417,563 | A * | 5/1995 | Cirami | 431/153 |
| 5,448,931 | A * | 9/1995 | Fossella et al. | 81/63.2 |
| 6,012,916 | A * | 1/2000 | Liang | 431/153 |
| 6,093,017 | A * | 7/2000 | Saito et al. | 431/153 |
| 6,126,437 | A * | 10/2000 | Lixiang et al. | 431/153 |
| 6,343,928 | B1 * | 2/2002 | Liang | 431/153 |
| 6,565,354 | B2 * | 5/2003 | Liang | 431/153 |
| 6,663,383 | B2 * | 12/2003 | Jon | 431/153 |
| 6,666,679 | B1 * | 12/2003 | Ye | 431/153 |
| 7,556,494 | B2 * | 7/2009 | Huang | 431/153 |
| 2003/0049576 | A1 * | 3/2003 | Jon | 431/153 |
| 2008/0213712 | A1 * | 9/2008 | Huang | 431/153 |
| 2009/0104574 | A1 * | 4/2009 | Ruan | 431/132 |

FOREIGN PATENT DOCUMENTS

JP 63-134252 U 9/1988

OTHER PUBLICATIONS

Japanese Office Action for Japanese Action for Japanese Patent Application No. 2008-191219 dated May 11, 2010.

* cited by examiner

*Primary Examiner* — Kenneth B Rinehart
*Assistant Examiner* — Jorge Pereiro
(74) *Attorney, Agent, or Firm* — Kenealy Vaidya LLP

(57) ABSTRACT

An igniter can include a safety mechanism which is easily operated by an adult but is difficult for a child to release. In particular, an igniter can include: a nozzle section which emits a flame; a fuel introduction section; an ignition section which ignites the introduced fuel, wherein the ignition section is configured in such a manner that the fuel is ignited by movement of an ignition operating section to an ignition position; a movement restricting section having restricting sections which restrict the movement of the ignition operating section; and a permitting section which permits movement. When moving the movement restricting section, either the restricting sections or the permitting section can be disposed so as to correspond to the direction of movement of the ignition operating section.

11 Claims, 10 Drawing Sheets

IGNITER

This application claims the priority benefit under 35 U.S.C. §119 of Japanese Patent Application No. 2008-191219 filed on Jul. 24, 2008, which is hereby incorporated in its entirety by reference.

BACKGROUND OF THE INVENTION

1. Field of the Invention

The present invention relates to an igniter which emits a flame from a nozzle, and more particularly, to an igniter comprising a safety mechanism for guaranteeing safety.

2. Description of the Related Art

Conventionally, an igniter, such as a torch burner, is installed in a gas cartridge which contains gas. A torch burner of this kind is composed so that it takes the gas inside the gas cartridge into the interior of the burner, a spark discharge is then induced in the gas thus taken in, by using a piezoelectric material or the like, thereby igniting the gas, and the resulting flame is emitted from a nozzle.

A composition is adopted whereby the spark discharge is generated in a straightforward fashion by means a user operating, with his or her finger, a movable plate called a trigger which is provided in the torch burner.

For this reason, the user is able to take up the torch burner, in a state where the torch burner has been installed on a gas cartridge and gas has been introduced into the torch burner, and the user can ignite the burner very easily simply by operating the trigger with a finger of the hand which is holding the burner. Therefore, this igniter has excellent usability.

However, although a torch burner of this kind is very easy to use when handled by an adult, since a flame can readily be produced from the nozzle, there is a risk of danger when it is used by a child.

Therefore, in the prior art, it has been proposed that a torch burner, or the like, should incorporate a safety device which prevents a child from operating the trigger easily (see, for example, U.S. Pat. No. 6,840,759 (FIG. 3, etc.).

However, in practice, a safety device of this kind may be released simply by a child, and hence there have been demands for a safety device which is difficult for child to release. Naturally, if the structure of the safety device is made extraordinarily complex, then a safety device which is difficult for a child to release can be obtained, but this also makes the device difficult for even an adult to release, and thus impairs the usability of the torch burner.

Consequently, there has been a problem of developing a safety device which is difficult for a child to release but which still maintains good usability for an adult user.

SUMMARY OF THE INVENTION

Therefore, it is an object of the present invention to provide an igniter comprising a safety mechanism which is easily operated by an adult but is difficult for a child to release.

The object of the present invention is achieved by providing an igniter comprising: a nozzle section which emits a flame; a fuel introduction section which introduces fuel; and an ignition section which ignites the introduced fuel, wherein the ignition section is configured in such a manner that the fuel is ignited by a movement of an ignition operating section, which is disposed on one side of a main body of the igniter, to an ignition position; a movement restricting section having restricting sections which restrict the movement of the ignition operating section to the ignition position and a permitting section which permits said movement is disposed with respect to the ignition operating section; the movement restricting section is configured in such a manner that by moving the movement restricting section, either the restricting sections or the permitting section can be located so as to correspond to a direction of movement of the ignition operating section; and a movement restricting section operating section which controls the movement of the movement restricting section is disposed on the main body of the igniter on a side opposite to the side where the ignition operating section is disposed.

According to this composition, a movement restricting section having restricting sections which restrict the movement of the ignition operating section to the ignition position and a permitting section which permits such movement are provided with respect to the ignition operating section, the movement restricting section being configured in such a manner that by moving the movement restricting section, either the restricting sections or the permitting section can be located so as to correspond to the direction of movement of the ignition operating section, and a movement restricting section operating section which controls the movement of the movement restricting section is disposed on the main body of the igniter on a side opposite to the side where the ignition operating section is disposed.

Therefore, the user of the igniter must move the movement restricting section and align the permitting section with the ignition operating section in order to be able to move the ignition operating section to the ignition position.

Furthermore, a composition is adopted in which the movement restriction section operating section must be operated in order to move the movement restricting section.

This movement restriction section operating section is disposed on the opposite side of the main body of the igniter with respect to the side where the ignition operating section is disposed. Therefore, the user who is operating the igniter is required simultaneously to operate a movement restriction section operating section and an ignition operating section which are disposed on mutually opposite sides of the main body.

An operation of this kind it difficult to perform with one hand and therefore it is necessary for the user to perform the operation using both hands. This requires an extremely difficult operation for a child and hence the safety mechanism is one which it is difficult for a child to release.

On the other hand, since the operation can be performed readily by an adult provided that he or she uses both hands, then good usability can be maintained.

Desirably, the permitting section and the restricting sections of the movement restricting section are disposed so as to correspond to the direction of movement of the movement restricting section, the permitting section being disposed between respective restricting sections, and restricting section side stopper sections, which restrict the movement of the ignition operating section between the permitting section and the restricting sections, being formed in the boundary portions between the permitting section and the restricting sections.

According to this composition, the permitting section and the restricting sections of the movement restricting section are disposed so as to correspond to the direction of movement of the movement restricting section, and therefore the user is able to locate the ignition operating section selectively at the position of the permitting section or restricting sections of the movement restricting section, by moving the movement restricting section, and hence a easily usable composition is achieved.

Furthermore, according to the composition described above, the permitting section is disposed between restricting sections on both sides thereof, and restricting section side stopper sections which restrict the movement of the ignition operating section between the permitting section and the restricting sections are provided in the boundary portions between the permitting section and the restricting sections. Therefore, when the ignition operating section is located at a restricting section, even if the movement restricting section is moved in this state, the ignition operating section is prevented from moving by the restricting section side stopper sections and therefore cannot be located at the permitting section.

Consequently, if the position of the ignition operating section is not aligned accurately with the position of the permitting section of the movement restricting section, then the ignition operating section cannot be moved to the ignition position and therefore a safety mechanism which is even harder for a child to operate is achieved.

Desirably, the movement restricting section has a holding section for causing the ignition operating section to remain in the ignition position when the ignition operating section have been moved to the ignition position via the permitting section, and the holding section is formed adjacently to or in the vicinity of the permitting section along the direction of movement of the movement restricting section.

According to the composition described above, the movement restricting section has a holding section for causing the ignition operating section to remain in the ignition position when the ignition operating section has been moved to the ignition position via the permitting section. Therefore, provided that the user has located the ignition operating section in the holding section, then even if the user ceases to operate the ignition operating section, an ignited state can still be maintained.

Furthermore, since the holding section is formed adjacently to or in the vicinity of the permitting section along the direction of movement of the movement restricting section, then a composition is achieved in which the user is able to move and change the location of the ignition operating section easily from the permitting section to the holding section, by moving the movement restricting section.

Desirably, an ignition operation impelling section, which applies an impelling force to the ignition operating section in a direction which presses the ignition operating section against the holding section, is provided; and a holding section side stopper section which restricts the movement of the ignition operating section between the permitting section and the holding section is formed in the boundary portion between the permitting section and the holding section.

According to the composition described above, since the ignition operation impelling section which applies an impelling force to the ignition operating section is provided in the direction which presses the ignition operating section against the holding section, then due to this impelling force, the ignition operating section is held reliably in the region of the holding section.

Moreover, since a holding section side stopper section is provided in the boundary region of the permitting section and the holding section in order to restrict the movement of the ignition operating section between the permitting section and the holding section, then the ignition operating section can be prevented reliably from becoming detached unintentionally from the holding section.

Desirably, the igniter is composed in such a manner that fuel is introduced into the ignition section by a movement of the ignition operating section toward the ignition position, and the introduction of fuel into the ignition section is prohibited by a movement of the ignition operating section away from the ignition position; the movement restricting section has a movement restriction impelling section, which applies an impelling force in such a manner that the movement restricting section moves along a direction from the holding section toward the permitting section; the permitting section is an opening section which permits the ignition operating section to move from a position of separation from the movement restricting section to the ignition position; and the holding section side stopper section is a projecting section which projects in a direction from the position of separation toward the ignition position.

According to the composition described above, a composition is adopted in which the fuel is introduced into the ignition section by a movement of the ignition operating section toward the ignition position, and the introduction of fuel into the ignition section is prohibited by a movement of the ignition operating section away from the ignition position, the movement restricting section has a movement restriction impelling section which applies an impelling force in such a manner that the movement restricting section moves along a direction from the holding section toward the permitting section, the permitting section is an opening section which permits the ignition operating section to move from a position of separation from the movement restricting section to the ignition position, and the holding section side stopper section is a projecting section which projects in a direction from the position of separation toward the ignition position.

Therefore, the ignition operating section receives an impelling force which seeks to move it relatively from the holding section toward the permitting section.

If the user moves the ignition operating section in the direction from the position of separation toward the ignition position, against the impelling force of the ignition operation impelling section, then the ignition operating section passes over the projecting section. In this case, the movement restricting section moves in the direction from the holding section toward the permitting section due to the movement restriction impelling section, and therefore the ignition operating section moves from the holding section toward the opening section and moves via the opening section to a non-ignition position where the entry of fuel into the ignition section is prevented, thereby causing automatic extinction.

Consequently, it is possible for a user to change the igniter from an ignited state to an extinguished state, quickly, easily and safely, simply by operating the ignition operating section.

The present invention has a beneficial effect in that it is able to provide an igniter comprising a safety mechanism which is easily operated by an adult but is difficult for a child to release.

DESCRIPTION OF THE PREFERRED EMBODIMENTS

Below, preferred embodiments of the present invention are described in detail with reference to the accompanying drawings, and the like.

The embodiments described below are preferred concrete example of the present invention, and therefore various desirable technical restrictions are applied, but the scope of the present invention is not limited to these modes, unless a specific reference limiting the present invention is made in the following description.

Figure 1:
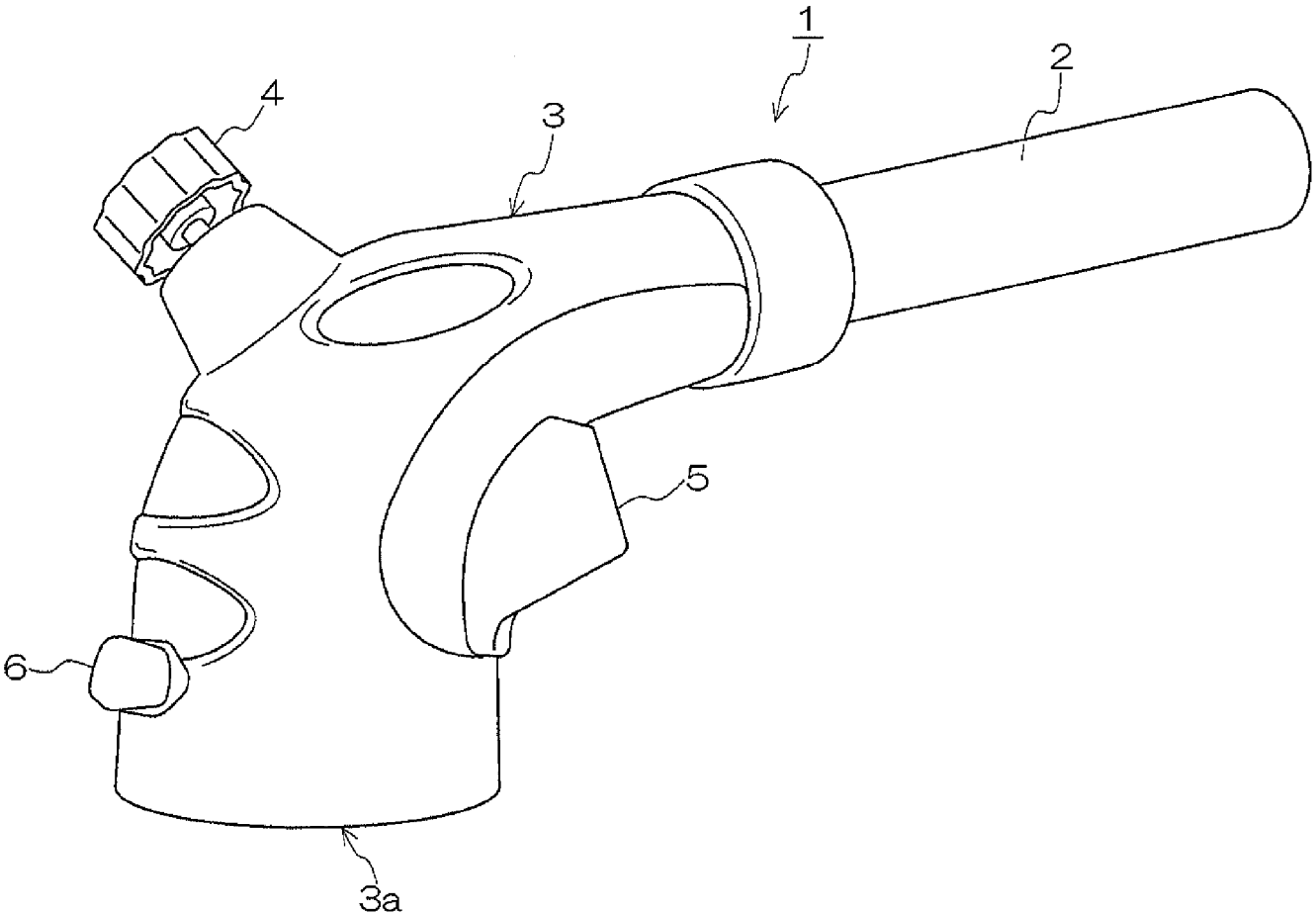
FIG. 1 is an approximate oblique diagram showing a torch burner, which is an example of an igniter according to the present invention.

FIG. 1 is an approximate oblique diagram showing a torch burner 1, which is an example of the igniter according to the present invention. As shown in FIG. 1, the torch burner 1 comprises a metal nozzle 2 made of stainless steel, for example, which is a nozzle section that emits a flame, and a torch burner main body 3.

A cartridge installation port 3*a* is formed on the under side of the torch burner main body 3 and provides a fuel introduction section for installing a cartridge (not illustrated) containing a fuel, such as gas, for instance.

In other words, the torch burner main body 3 has a composition wherein, by installing a cartridge containing gas in the cartridge installation port 3*a*, the gas is introduced into the torch burner main body 3.

Furthermore, as shown in FIG. 1, a gas regulation knob 4 for adjusting the amount gas introduced from the cartridge and into the torch burner 3 is provided in the torch burner main body 3. Moreover, the torch burner main body 3 also has a trigger 5, which is one example of an ignition operating section, which permits the entry of gas into the torch burner main body 3 as well as activating the ignition section which ignites the gas that has been introduced.

In addition, a safety lever 6 is also provided, which is one example of an operating section for a movement restricting section operating section which is described hereinafter.

Figure 2:
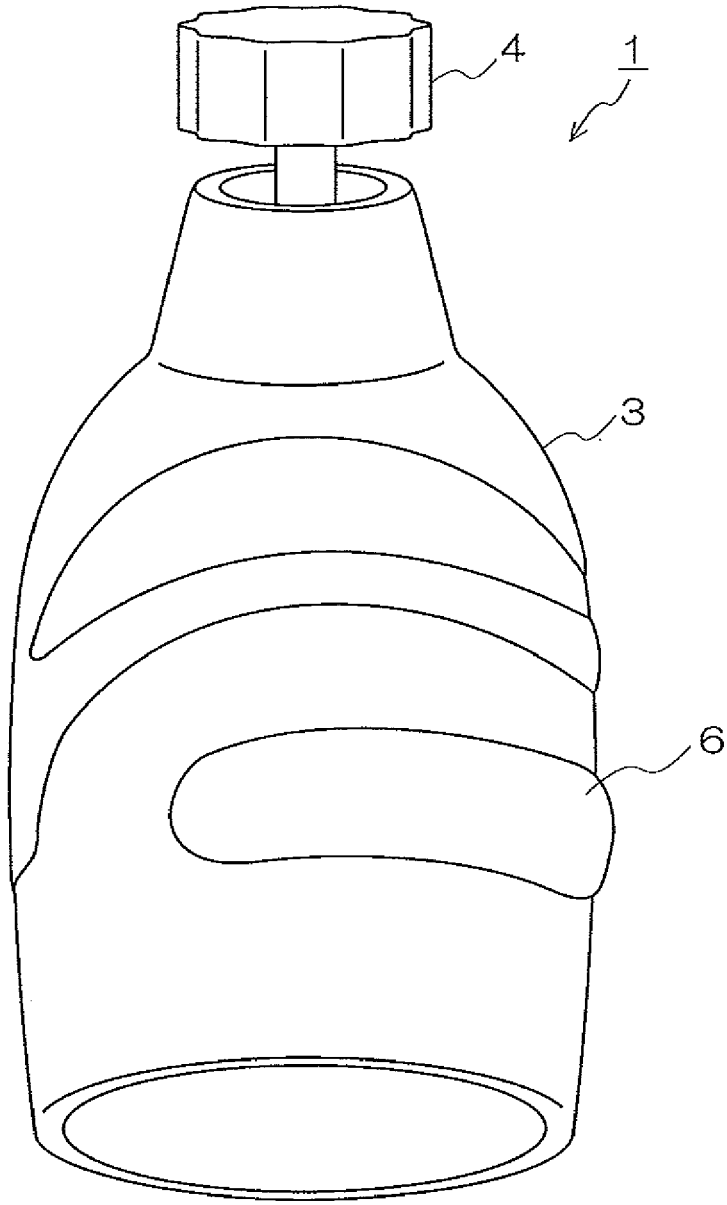
FIG. 2 is an approximate left-hand side view of the torch burner in FIG. 1.

FIG. 2 is an approximate left-hand side view of the torch burner 1 in FIG. 1, and as shown in FIG. 2, the safety lever 6 has an elliptical shape which is elongated in the lateral direction, and is therefore easy to handle by the operator.

Figure 3:
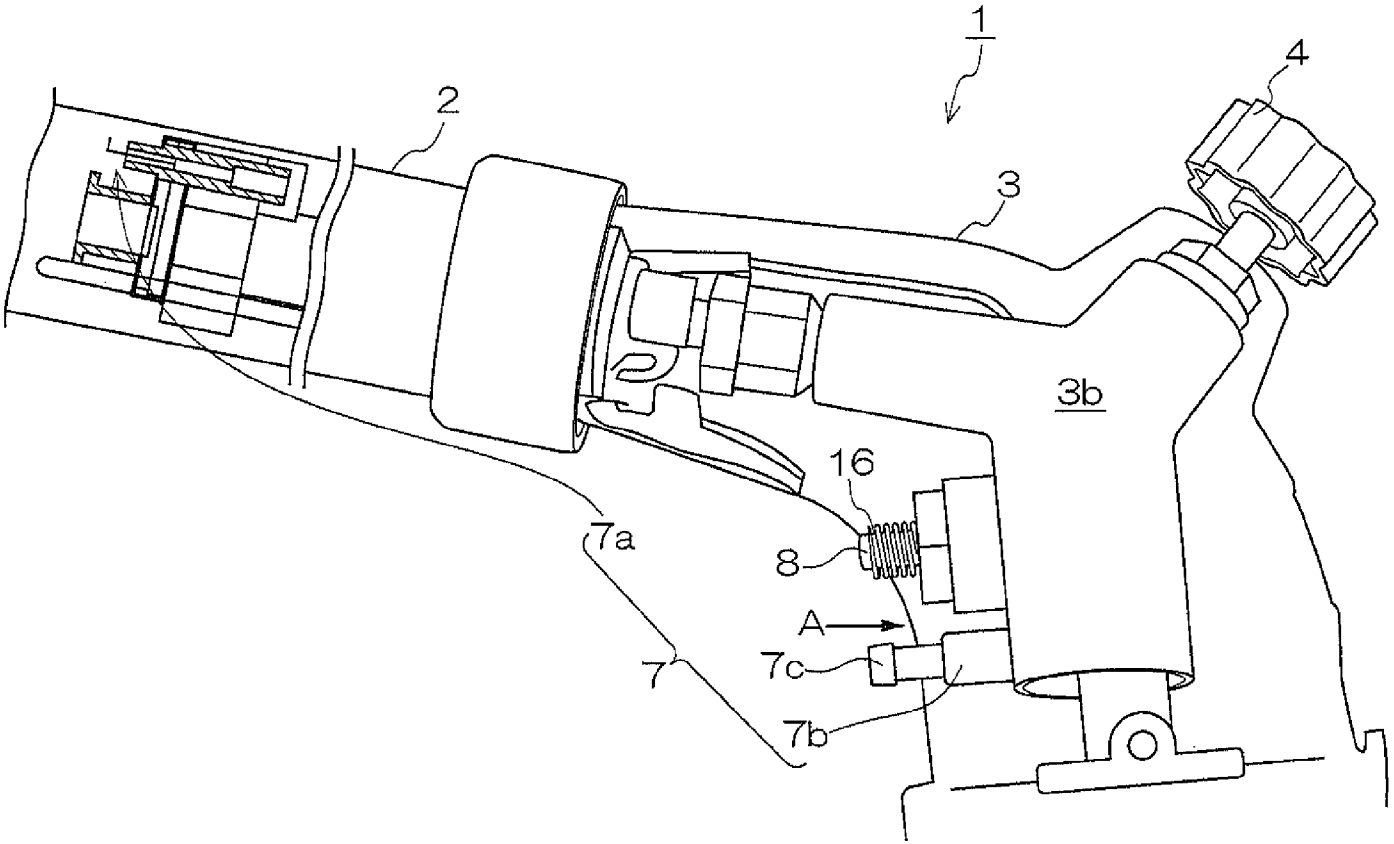
FIG. 3 is an approximate diagram showing a state where the resin surface cover has been removed from the rear surface side of the torch burner in FIG. 1.

FIG. 3 is an approximate diagram showing a state where the resin surface cover has been removed from the rear surface side of the torch burner 1 in FIG. 1.

As shown in FIG. 3, a mechanism main body 3*b* by which gas is introduced into the torch burner is provided inside the torch burner main body 3. Furthermore, an ignition section main body 7*a* is provided on the side of the mechanism main body 3*b* which is adjacent to the nozzle 2. Electrodes are provided in this ignition section main body 7*a* and a composition is adopted whereby a spark discharge is produced between these electrodes, the gas is ignited by this spark and a flame is emitted from the nozzle 2 accordingly.

Furthermore, the spark discharge in the ignition section main body 7*a* is generated by striking a piezoelectric body inside the ignition switch 7*b* in FIG. 3. More specifically, when the trigger 5 in FIG. 1 moves in the direction of arrow A in FIG. 3, the switch tip section 7*c* is pressed and duly strikes against the piezoelectric body inside the ignition switch 7*b*, thereby generating a spark discharge in the ignition section main body 7*a*.

The ignition section 7 is constituted by the ignition section main body 7*a*, the ignition switch 7*b* and the switch tip section 7*c*, or the like described above. The position at which the trigger 5 presses the switch tip section 7*c* and strikes the piezoelectric body inside the ignition switch 7*b* is one example of the ignition position.

Next, the flow of gas inside the torch burner main body 3 of the torch burner 1 and the mechanism for controlling same will be described.

Figure 4:
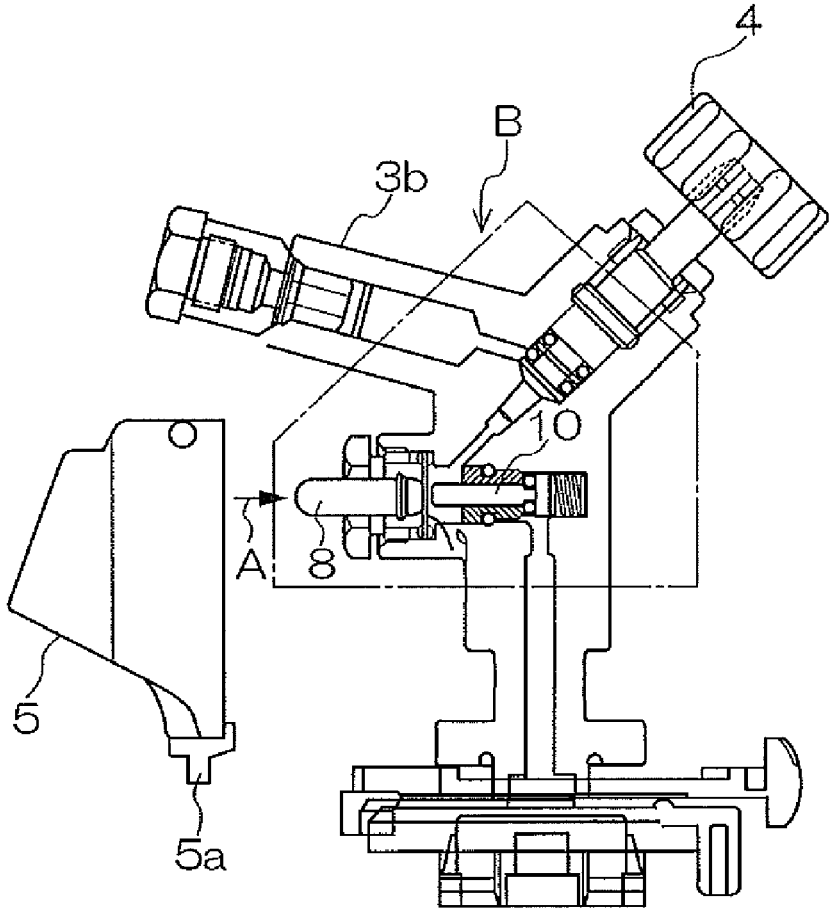
FIG. 4 is an approximate diagram showing the main composition inside the main body of the mechanism in FIG. 3.
Figure 5:
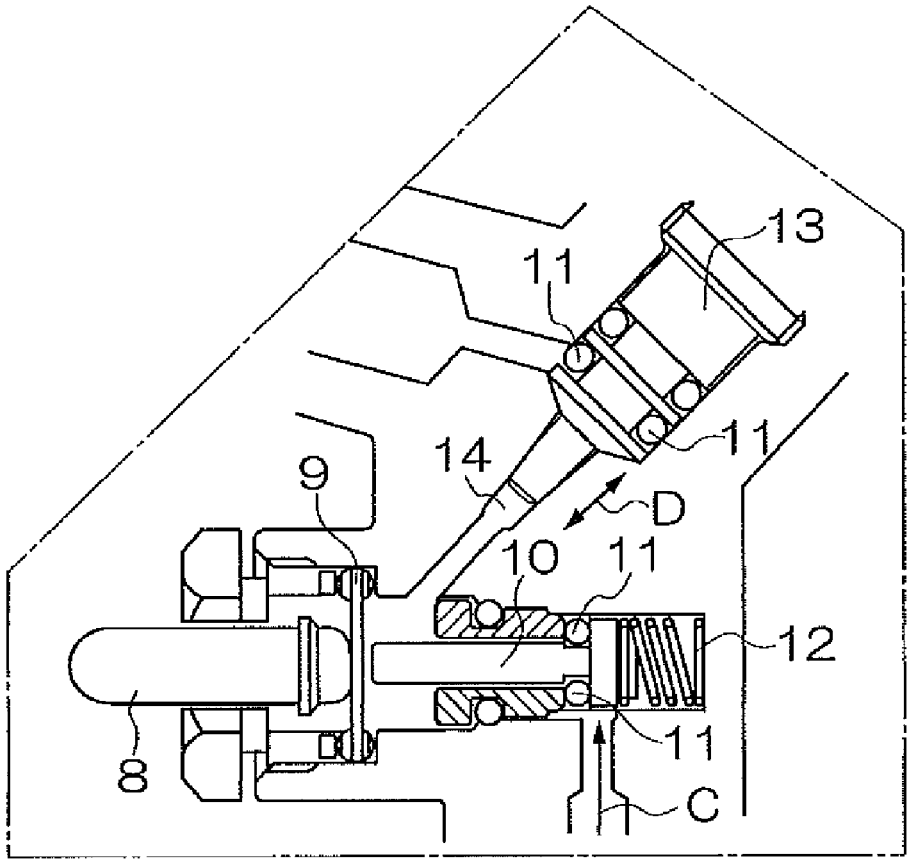
FIG. 5 is an approximate enlarged view showing the portion indicated by arrow B in FIG. 4.

FIG. 4 is an approximate diagram showing the main composition of the interior of the mechanism main body 3*b* in FIG. 3, and FIG. 5 is an approximate enlarged diagram showing the portion indicated by arrow B in FIG. 4.

FIG. 4 and FIG. 5 show a state where the gas regulating knob 4 is in a closed state and the gas introduced from the cassette is not flowing toward the nozzle 2. A more detailed description is given below.

As shown in FIG. 4, a first check pin 8 which abuts against the trigger 5 and is pressed by the trigger 5 in the direction of arrow A in FIG. 4 is provided in the mechanism main body 3*b*. A diaphragm 9 is disposed on the right-hand side of this first check pin 8 in the drawing, and a second check pin 10 is disposed on the right-hand side of the diaphragm 9. This second check pin 10 is formed approximately in the shape of T laid on its side, as shown in FIG. 4.

Moreover, as shown in FIG. 4 and FIG. 5, an O ring 11 is provided on the second check pin 10, and a spring 12 is provided on the right-hand side of the second check pin 10.

Consequently, even if gas enters into the torch burner 1 from the cartridge in the direction of arrow C in FIG. 5, the passage of the gas is shut off by the O ring 11 and the second check pin 10, and the gas does not enter into the nozzle 2.

On the other hand, as shown in FIG. 4 and FIG. 5, a spindle 13 is connected to the gas regulating knob 4, and by turning this gas regulating knob 4, the spindle 13 is moved in the direction of arrow D in FIG. 5.

In other words, when the gas regulating knob 4 is turned in the closing direction, the spindle 13 moves in the leftward and downward direction in FIG. 5, and thus moves in a direction which shuts off the gas channel 14.

Consequently, in the state shown in FIG. 4 and FIG. 5, the gas from the cartridge is completely shut off.

Figure 6:
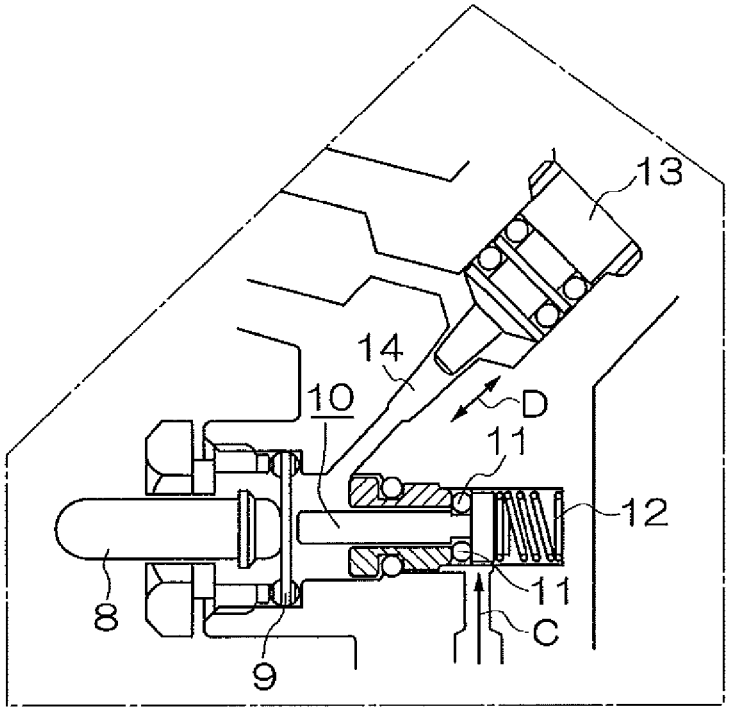
FIG. 6 is an approximate enlarged diagram showing a state where the gas regulating knob in FIG. 5 has been turned in the opening direction.

FIG. 6 is an approximate enlarged diagram showing a state where the gas regulating knob 4 in FIG. 5 has been turned in the opening direction. In FIG. 6, the spindle 13 moves with the rotation of the gas regulating knob 4 and it moves toward the rightward and upward direction in FIG. 6 following the direction of arrow D in FIG. 6. Consequently, the gas channel 14 is opened as shown in FIG. 6, and becomes connected with the nozzle 2 side.

However, the positions of the second check pin 10 and the O ring 11 are similar to those in FIG. 5, and therefore the gas in the cartridge does not enter into the nozzle 2 side.

Figure 7:
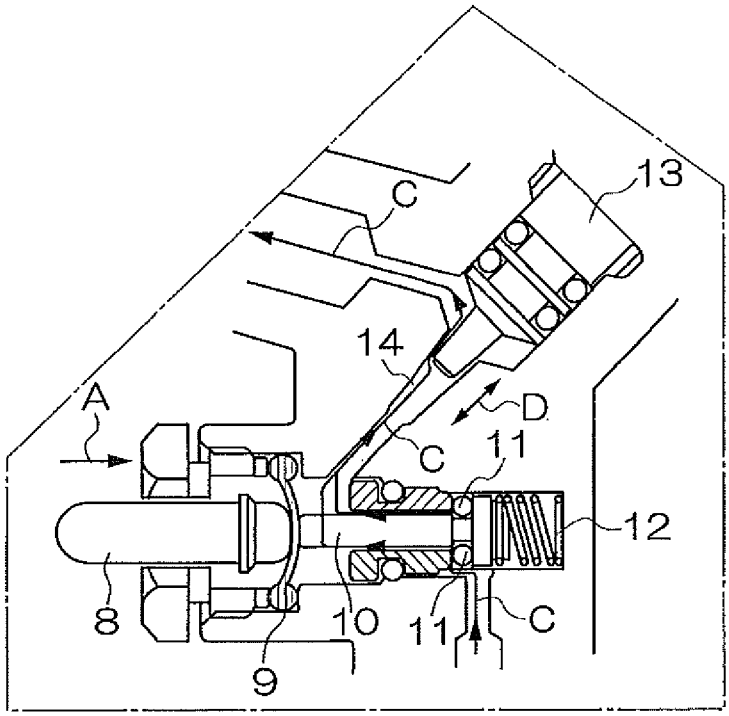
FIG. 7 is an approximate diagram showing a state where the spindle is in the same position as in FIG. 6 and the first check pin has been pressed by the trigger.

FIG. 7 is an approximate diagram showing a state where the spindle 13 is in the same position as in FIG. 6 and the first check pin 8 is pressed by the trigger 5.

The first check pin 8 shown in FIG. 7 is pressed in the direction of arrow A by the trigger 5 in FIG. 4, and consequently, the diaphragm 9 which is located on the right-hand side is deformed so as to bend in the rightward direction. Accordingly, the second check pin 10 is pressed toward the right, and when this pressing force exceeds the impelling force of the spring 12, then the second check pin 10 moves in the direction of arrow A.

Due to this, a gap appears between the second check pin 10 and the O ring 11, and the gas in the cartridge is introduced into the gas channel 14 in the direction of arrow C. In the state shown in FIG. 7, as described above, the gas channel 14 is connected to the nozzle 2 side, and therefore the gas which has been introduced into the gas channel 14 enters directly into the nozzle 2.

In this way, in the torch burner 1 according to the present embodiment, in order to introduce gas into the nozzle 2 side, rather than simply opening the gas regulating knob 4 it is also necessary to operate the trigger 5, and therefore a composition which takes account of safety considerations is achieved.

Moreover, the amount of gas introduced into the nozzle 2 side is adjusted by rotating and changing the amount of opening of the gas regulating knob 4 (namely, changing the position of the spindle in FIG. 7).

Figure 8:
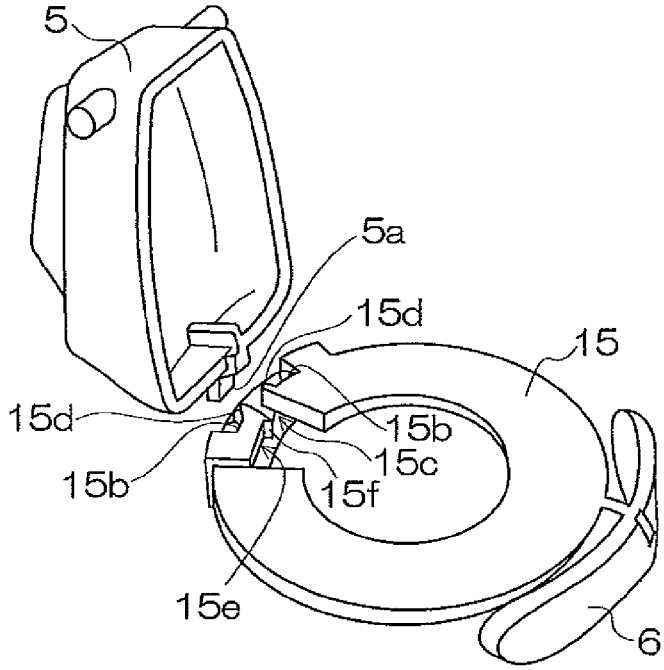
FIG. 8 is an approximate diagram showing the main composition of the safety mechanism of the torch burner according to the present embodiment.

Next, the safety mechanism of the torch burner 1 will be described. FIG. 8 is an approximate diagram showing the main composition of the safety mechanism of the torch burner 1 according to the present embodiment. FIG. 8 shows the trigger 5 shown in FIG. 4, the safety lever 6 shown in FIG. 1 and other drawings, and a safety device 15 which is an example of a movement restricting section that is connected to the safety lever 6.

As shown in FIG. 8, this safety device 15 is formed in an approximate circular disk shape having an opening in the central portion thereof, and a groove section which connects the opening in the central portion with the exterior is formed in this approximate circular disk shape.

Furthermore, a guide section 5*a* which is also shown in FIG. 4 is formed on the lower end portion of the trigger 5 in FIG. 8. This guide section 5*a* is one example of an ignition operating section.

Figure 9:
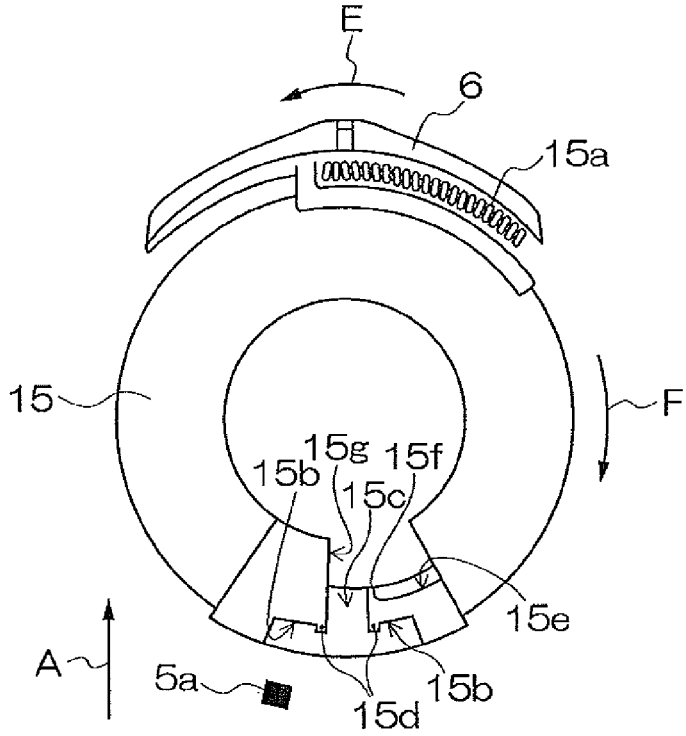
FIG. 9 is an approximate plan diagram showing the safety lever, the safety device and the guide section in FIG. 8.

FIG. 9 is an approximate plan diagram showing the safety lever 6, the safety device 15 and the guide section 5*a* in FIG. 8.

In the torch burner 1 according to the present embodiment, this safety device 15 is disposed between the trigger 5 and the mechanism main body 3*b* shown in FIG. 4. Therefore, a composition is achieved in which the trigger 5 in FIG. 4 abuts against the first check pin 8 via the safety device 15.

In other words, by means of the safety device 15, a composition is achieved in which the trigger 5 can be prevented from abutting against and pressing the first check pin 8 unnecessarily.

Below, the composition of the safety device 15 is described in detail. As shown in FIG. 8 and FIG. 9, a groove section 15*c* which is one example of a permitting section (opening section) which enables the passage of the guide section 5*a* is formed in the safety device 15, and restricting sections 15*b* which prohibit the passage of the guide section 5*a* are formed on both sides of the groove section 15*c*.

Therefore, a composition is achieved in which even when the user operates the trigger 5 in FIG. 4 so as to move in the direction of arrow A, if the guide section 5*a* is not able to pass through the groove section 15*c*, then the first check pin 8 in FIG. 4 cannot be pressed.

Furthermore, in the initial setup of the torch burner 1, as shown in FIG. 9, the guide section 5*a* of the trigger 5 is disposed at a position corresponding to the restricting section 15*b* of the safety device 15. Therefore, in a state where the safety device 15 has not been moved, the trigger 5 is inhibited by the safety device 15, and the first check pin 8 cannot be operated.

As shown in FIG. 9, a spring 15*a* which is an example of a movement restricting impelling section is provided in the safety device 15, and the safety device 15 receives an impelling force in the direction of arrow E in FIG. 9 due to the presence of this spring 15*a*.

Therefore, when the user operates the safety lever 6 and turns same in the direction of arrow F in FIG. 9 against the impelling force of the spring 15*a*, the safety device 15 rotates in the direction of arrow F, whereas when the user releases the safety lever 6 then the safety device 15 returns to the original position due to the impelling force of the spring 15*a*.

In other words, a composition is achieved whereby, when the user moves the safety lever 6 in the direction of arrow F in FIG. 9 and the groove section 15*c* is situated in a position corresponding to the guide section 5*a*, then firstly the guide section 5*a* passes through the safety device 15 via the groove section 15*b* and is then able to reach the first check pin 8 in FIG. 4.

In this way, the safety device 15 is composed in such a manner that by being turned, the restricting sections 15*b* or the groove section 15*c* can be positioned so as to correspond to the direction of movement of the guide section 5*a* (the direction of arrow A in FIG. 9).

Furthermore, as shown in FIG. 9, the restricting sections 15*b* and the groove section 15*c* of the safety device 15 are positioned so as to correspond to the direction of movement of the guide section 5*a* (the direction of arrow in FIG. 9), and as described above, the groove section 15*c* is disposed so as to be positioned between the two restricting sections 15*b*, 15*b*.

The end portions of the restricting sections 15*b*, 15*b* on the side adjacent to the groove section 15*c*, which are examples of the boundary portions between the groove section 15*c* and the restricting sections 15*b*, 15*b*, are respectively provided with restricting section side stoppers 15*d*, 15*d* formed in a projecting shape, which are examples of restricting section side stopper sections.

Furthermore, as shown in FIG. 8 and FIG. 9, a holding section 15e is formed on the inner circumferential side(the side toward the central section) of the right-hand side restricting section 15*b* side of the groove section 15*c* of the safety device 15. This holding section 15*e* is a section which serves to hold the guide section 5*a* (in other words the trigger 5) in position when it has entered into the central section side via the groove section 15*c* and has been located in the ignition position where it presses against the first check pin 8 in FIG. 4.

This holding section 15*e* is disposed adjacently to the groove section 15*c* following the direction of movement of the safety device 15 (the directions indicated by arrows F and E), thereby achieving a composition whereby the guide section 5*a* can readily be positioned in the holding section 15*e* by rotating the safety device 15.

Furthermore, as shown in FIG. 3, a check pin spring 16 is provided on the first check pin 16. As shown in FIG. 4, this check pin spring 16 is composed so as to generate an impelling force which causes the trigger 5 to move in the opposite direction to the arrow A in FIG. 4 (the direction away from the check pin 8), when the trigger 5 presses against the first check pin 8.

This check pin spring 16 is one example of an ignition operation impelling section.

Therefore, in a state where the guide section 5*a* is disposed in the holding section 15*e* shown in FIG. 9, the guide section 5*a* is pressed up against the holding section 15*e* by the action of the check pin spring 16, and is therefore positioned stably in the holding section 15*e*, thus making it possible to maintain the ignition position.

Furthermore, in the present embodiment, moreover, a holding section side stopper 15*f* is formed on the groove section 15*c* side of the holding section 15*e*, which is one example of the boundary portion between the holding section 15*e* and the groove section 15*c*. This holding section side stopper 15*f* is one example of a projecting section which is formed so as to project in a direction which moves the guide section 5*a* toward the ignition position from a position of separation from the safety device 15 (in other words, a direction toward the central section).

Accordingly, a composition is achieved in which the guide section 5*a* is pressed more reliably up against the holding section 15*e* rather than moving apart from the holding section 15*e*.

Furthermore, if the user operates the trigger 5 when the guide section 5*a* is in a state of being pressed against the holding section 15*e*, and the guide section 5*a* moves beyond the height of the holding section side stopper 15*f*, then the pressing force of the trigger 5 which is applied to the safety device 15 ceases to exist. Consequently, the safety device 15 starts to rotate in the direction of the arrow E in FIG. 9, due to the impelling force of the spring 15*a*. In so doing, the guide section 5*a* changes its relative position and abuts against an abutment section 15*g* which is connected to the groove section 15*c* in FIG. 9. In this way, a composition is achieved in which the guide section 5*a* moves away from the ignition position along the groove section 15*c* due to the impelling force of the check pin spring 16 in FIG. 3.

Furthermore, as shown in FIG. 3 and FIG. 4, the trigger 5 of the torch burner 1 according to the present embodiment is composed in such a manner that it presses against both the first check pin 8 and the switch tip section 7*c* of the ignition section 7 when moved in the direction of the arrow A in FIG. 3.

Consequently, the first check pin 8 is pressed and gas is introduced into the torch burner 1 by means of a simple operation of moving the trigger 5 in the direction of arrow A, and simultaneously the gas can be ignited by the pressing of the switch tip section 7*c*.

On the other hand, if the trigger 5 is conversely separated from the first check pin 8 and the switch tip section 7*c*, then the second check pin 10 etc. returns to its original position due to the impelling force of the spring 12 in FIG. 5, the entry of gas into the torch burner 1 is prohibited and hence the emission of the flame from the torch burner 1 is halted.

Consequently, as described above, a composition is achieved in which the torch burner 1 is automatically extinguished when the guide section 5*a* is moved toward the outer side along the groove section 15*c*, due to the impelling force of the check pin spring 16 in FIG. 3.

The safety mechanism of the torch burner 1 has the composition described above, and below the operation of this safety mechanism is described in detail.

Firstly, the operation for releasing the safety mechanism and lighting the torch burner 1 will be described.

The user of the torch burner 1 as shown in FIG. 1 turns the gas regulating knob 4 and sets the spindle 13 to the open state shown in FIG. 6 and other drawings. Thereupon, the user slides the safety lever 6 in FIG. 1 in the direction of arrow F in FIG. 9 against the impelling force of the spring 15*a*. In so doing, the groove section 15*c* of the safety device 15 in FIG. 9 is located at the position corresponding to the direction of movement of the guide section 5*a* of the trigger 5 (the direction of arrow A).

Figure 10:
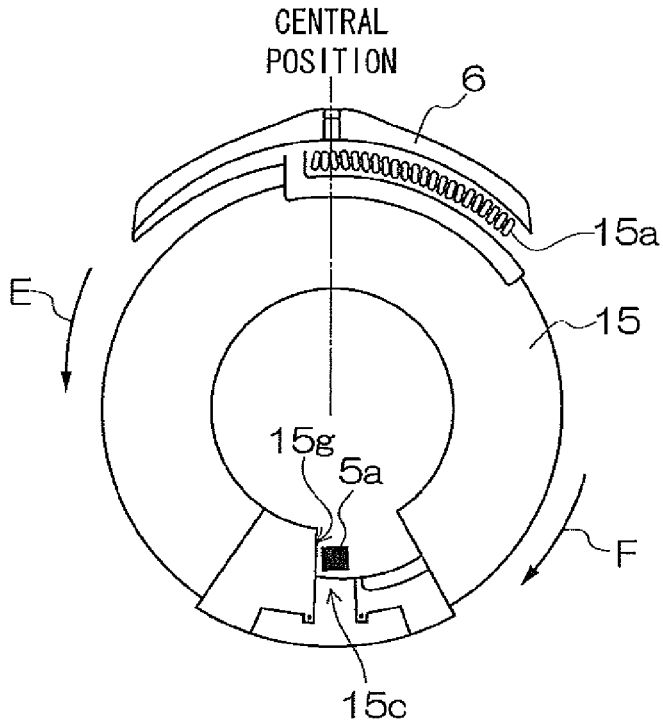
FIG. 10 is an approximate diagram of the principal portion of a torch burner showing a state where the safety mechanism has been released.

When the user moves the guide section 5*a* of the trigger 5 in the direction of arrow A, then as shown in FIG. 10, the guide section 5*a* passes through the groove section 15*c* and then the trigger 5 presses against the first check pin 8 and the switch tip section 7*c* in FIG. 3 and the torch burner 1 is lit. FIG. 10 is an approximate diagram of the principal portion of a torch burner 1 showing a state where the safety mechanism has been released.

In this case, the guide section 5*a* is abutted against the abutment section 15*g* which is disposed in connection with the groove section 15*c*, and therefore even if the user removes his or her hand from the safety lever 6, the safety device 15 can be prevented from turning in the direction of arrow E and returning to its original position due to the impelling force of the spring 15*a*, and therefore a composition which is easy for the user to operate is achieved.

Figure 11:
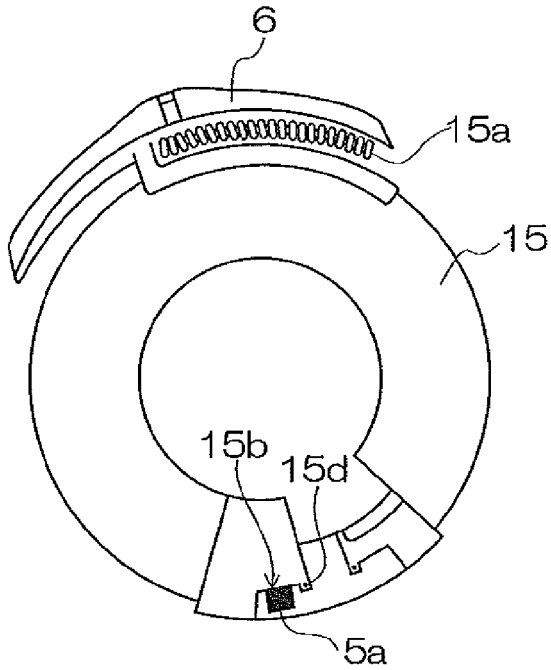
FIG. 11 is an approximate diagram of a state where the safety mechanism of the safety device is operating.

On the other hand, if the user moves the trigger 5 in the direction of arrow A in FIG. 4 without sliding the safety lever 6, then the state in FIG. 11 is obtained.

FIG. 11 is an approximate diagram of a state where the safety mechanism of the safety device 15 is operating.

As shown in FIG. 11, in this case, the guide section 5*a* abuts against the restricting section 15*b* of the safety device 15, thereby preventing movement of same, and hence the movement of the trigger 5 is also halted and no pressing of the first cutting point 8 and the switch tip section 7*c* occurs as shown in FIG. 3, meaning that the torch burner 1 is not ignited.

In this way, in the present embodiment, unless the user slides the safety device 15 against the impelling force of the safety device 15 which exerts an impelling force, halts the rotation of the safety device 15 at the position where the safety mechanism is released, and then operates the trigger 5 in this state, the safety mechanism is not released and the torch burner 1 cannot be lighted.

Moreover, the safety lever 6 and the trigger 5 which are used to slide the safety device 15 are disposed on mutually opposite sides of the torch burner main body 3 as shown in FIG. 1. In other words, the safety lever 6 is disposed at a position directly opposite the trigger 5.

Therefore, the trigger 5 which is disposed on directly the opposite side of the torch burner main body 3 in this way and the safety lever 6 which receives an impelling force must be operated simultaneously, and the safety lever 6 must be aligned with a particular position.

Consequently, it is difficult for the user to perform these operations with a single hand, but rather the user must employ both hands.

This requires an operation that is extremely difficult for a child and hence the safety mechanism is one which it is difficult for a child to release.

On the other hand, since the operation can be performed readily by an adult using both hands, then good usability can be maintained.

Moreover, in the torch burner 1 according to the present embodiment, even if it is sought to release the safety mechanism in the state shown in FIG. 11 and it is attempted to slide the safety lever 6 while pulling the trigger 5, the guide section 5*a* is prevented from moving by the restricting section side stopper 15*d*, and hence the safety mechanism cannot be released.

In this way, in the present embodiment, it is necessary to operate the safety lever 6 and set the safety device 15 accurately to a particular position, and if the safety device 15 is set at any time to the wrong position, then the safety mechanism cannot be released. Therefore, a mechanism providing an extremely high level of safety is obtained.

Figure 12:
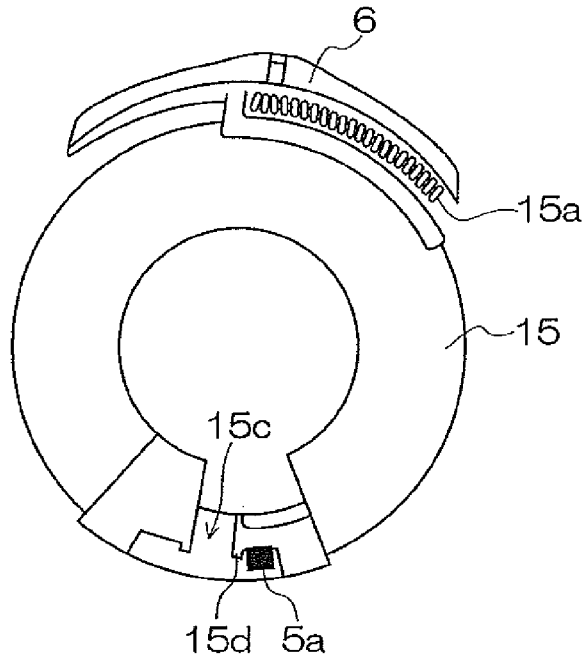
FIG. 12 is a further approximate diagram of a state where the safety mechanism of the safety device is operating.

FIG. 12 is a further approximate diagram of a state where the safety mechanism of the safety device 15 is operating.

FIG. 12 shows an example where it has not been possible to set the position of the groove section 15*c* of the safety device 15 so as to correspond to the position of the guide section 5*a*, similarly to FIG. 11, but in contrast to FIG. 11, FIG. 12 shows an example where the guide section 5*a* is abutted against the restricting section 15*b* on the opposite side of the groove section 15*c* (the right-hand side in FIG. 11 and FIG. 12).

In this case as well, the guide section 5*a* is impeded by the restricting section 15*b* and the safety mechanism cannot be released, in addition to which even if the trigger 5 is pulled, the guide section 5*a* will abut against the restricting section side stopper 15d and hence the safety mechanism cannot be released.

Figure 13:
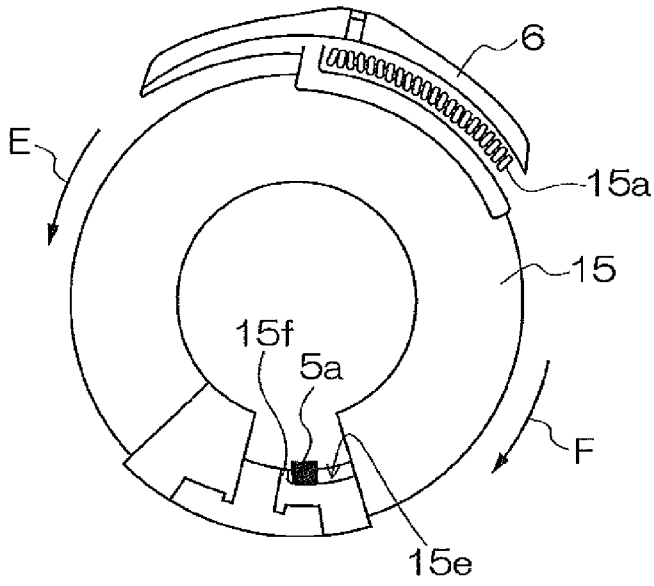
FIG. 13 is an approximate diagram showing a state where the guide section which is located in the ignition position as shown in FIG. 10 is maintained in this ignition position.

FIG. 13 is an approximate diagram showing a state where the guide section 5*a* which is located in the ignition position as shown in FIG. 10 is maintained in this ignition position.

More specifically, the user slides the safety lever 6 and moves the safety device 15 in the direction of the arrow F, in a state where the guide section 5*a* is disposed in the ignition position shown in FIG. 10.

In so doing, the guide section 5*a* passes beyond the holding section side stopper 15*f* and is located in the holding section 15e. If the user stops operating the trigger 5 and releases his or her finger in this state, then the guide section 5*a* is pressed against the holding section 15*e* by the impelling force of the check spring 16 shown in FIG. 3.

Furthermore, even if the user releases the safety lever 6 and the safety device 15 seeks to return in the direction of arrow E in FIG. 13 due to the impelling force of the spring 15*a*, the guide section 5*a* abuts against the holding section side stopper 15*f* thus prohibiting movement thereof, and the torch burner 1 can be maintained in the ignition position state, thus the torch burner 1 can provide good operability to the user.

Figure 14:
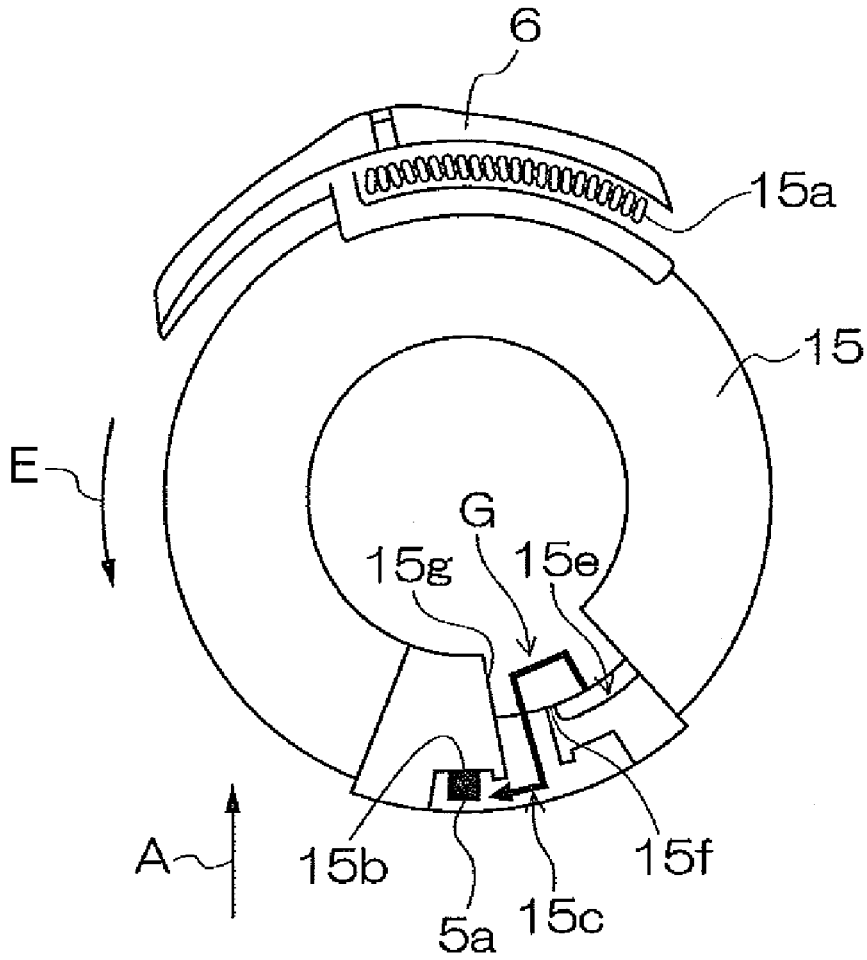
FIG. 14 is an approximate diagram showing an operation of automatic extinguishing of the torch burner shown in FIG. 1.

FIG. 14 is an approximate diagram showing the operation of the automatic extinguishing action of the torch burner 1. The arrow G in FIG. 14 shows the movement path of the guide section 5*a*. More specifically, firstly, in a state where the guide section 5*a* is disposed in the holding section 15*e* in FIG. 13, if the user wishes to finish using the torch burner 1, then the user firstly pulls the trigger 5 in the direction of arrow A, thereby causing the guide section 5*a* which was located in the holding section 15*e* to move toward the central section of the safety device 15 and ultimately arrive at a position where it has passed beyond the holding section side stopper 15*f*. In so doing, the safety device 15 is moved in the direction of arrow E due to the impelling force of the spring 15*a* of the safety device 15, and the guide section 5*a* abuts against the abutment section 15*g* which is connected to the groove section 15*c*. In this state, if the user removes his or her hand from the trigger 5, then the guide section 5*a* moves in the opposite direction to arrow A along the groove section 15*c*, due to the impelling force of the check pin spring 16 in FIG. 3. Therefore, since the trigger 5 has been removed from the position (ignition position) where it presses against the first check pin 8 in FIG. 4, the supply of gas to the nozzle 2 side is prevented and the burner is automatically extinguished.

As shown in FIG. 14, due to the movement of the safety device 15 in the direction of arrow E, the guide section 5*a* takes up a position at the restricting section 15*b*.

In this way, a composition is achieved in the torch burner 1 according to the present embodiment whereby, when the user has used the torch burner 1, the user can automatically extinguish the burner quickly and safely, just by pulling the trigger 5 once with their finger or the like and then releasing the trigger 5.

As described above, in the torch burner 1 according to the present embodiment, it is necessary to operate a safety lever 6 which is disposed on one side of the torch burner main body 3 and which is impelled by a spring 15*a*, so as to locate the safety device 15 in a particular position, as well as simultaneously operating a trigger 5 which is disposed directly opposite the safety lever 6, and therefore a mechanism which is difficult for a child to operate and which provides a very high level of safety is obtained.

The torch burner 1 relating to the present embodiment was subjected to a "test" based on "16 C.F.R. Part 1210" which is the safety standard set by the U.S. Consumer Product Safety Commission in relation to burners and similar devices, and it was clear than the torch burner 1 satisfied this standard.

An overview of the test items, the number of trial users and the test results is given below.

The test results were as follows: during a five minute test period, no child of a group of 100 children was successful in lighting the torch burner according to the present embodiment, and one child successfully lit the torch burner for the first time after 7 minutes and 10 seconds from the start of the test. Therefore, 99 percent of the children where unable to light the burner.

More specifically, lighting tests were carried out as indicated below with six respective lighters, using a sample group of 16 to 18 children.

| Lighter | No. of children | Successfully lit? |
|---|---|---|
| 1 | 17 | No |
| 2 | 18 | No |
| 3 | 17 | No |
| 4 | 16 | No |
| 5 | 16 | Yes (1 child) |
| 6 | 16 | No |
| | 100 (total) | 1 child successful |

The characteristics of the children who took part in the test described in the table above were as follows.

| Age | Male | Female | Total |
|---|---|---|---|
| 42 months to 44 months | 19 | 11 | 30 |
| 45 months to 48 months | 26 | 14 | 40 |
| 49 months to 51 months | 19 | 11 | 30 |
| Total | 64 | 36 | 100 |

In this way, it is evident that the torch burner 1 according to the present embodiment cannot be operated and lit by 99 percent of children, in a "test" based on the safety standard "16 C.F.R. Part 1210" set for burners and similar devices by the U.S. Consumer Product Safety Commission, and this demonstrates that the torch burner 1 has an extremely high level of safety.

Furthermore, good operability for adult users is still maintained, and therefore the torch burner 1 is easy for adults to use.

The present invention is not limited to the respective embodiments described above. Furthermore, each of the respective compositions according to the present embodiment may be partially omitted or combined with each other as desired.

What is claimed is:

1. An igniter, comprising:

a nozzle section which emits a flame;

a fuel introduction section which introduces fuel; and an ignition section which ignites the introduced fuel, wherein the ignition section is configured in such a manner that the fuel is ignited by a movement of an ignition operating section, which is disposed on one side of the main body of the igniter, to an ignition position;

a movement restricting section having restricting sections which restrict the movement of the ignition operating section to the ignition position and a permitting section which permits said movement is disposed with respect to the ignition operating section;

the movement restricting section is configured in such a manner that by moving the movement restricting section, either the restricting sections or the permitting section can be located so as to correspond to a direction of movement of the ignition operating section;

a movement restricting section operating section which controls the movement of the movement restricting section is disposed on the main body of the igniter on a side opposite to the side where the ignition operating section is disposed; and the movement restricting section has a holding section for causing the ignition operating section to remain in the ignition position when the ignition operating section has been moved to the ignition position via the permitting section, and the holding section is formed adjacently to or in the vicinity of the permitting section along the direction of movement of the movement restricting section.

2. The igniter according to claim 1, wherein the permitting section and the restricting sections of the movement restricting section are disposed so as to correspond to the direction of movement of the movement restricting section, the permitting section being disposed between respective restricting sections, and restricting section side stopper sections, which restrict the movement of the ignition operating section between the permitting section and the restricting sections, being formed in the boundary portions between the permitting section and the restricting sections.

3. The igniter according to claim 1, wherein an ignition operation impelling section, which applies an impelling force to the ignition operating section in a direction which presses the ignition operating section against the holding section, is provided, and a holding section side stopper section which restricts the movement of the ignition operating section between the permitting section and the holding section is formed in the boundary portion between the permitting section and the holding section.

4. The igniter according to claim 3, wherein fuel is introduced into the ignition section by a movement of the ignition operating section toward the ignition position, and the introduction of fuel into the ignition section is prohibited by a movement of the ignition operating section away from the ignition position;

the movement restricting section has a movement restriction impelling section which applies an impelling force in such a manner that the movement restricting section moves along a direction from the holding section toward the permitting section;

the permitting section is an opening section which permits the ignition operating section to move from a position of separation from the movement restricting section to the ignition position; and the holding section side stopper section is a projecting section which projects in a direction from the position of separation toward the ignition position.

5. The igniter according to claim 1, wherein fuel is introduced into the ignition section by a movement of the ignition operating section toward the ignition position, and the introduction of fuel into the ignition section is prohibited by a movement of the ignition operating section away from the ignition position;

the movement restricting section has a movement restriction impelling section which applies an impelling force in such a manner that the movement restricting section moves along a direction from the holding section toward the permitting section;

the permitting section is an opening section which permits the ignition operating section to move from a position of separation from the movement restricting section to the ignition position; and the holding section side stopper section is a projecting section which projects in a direction from the position of separation toward the ignition position.

6. The igniter according to claim 1, wherein fuel is introduced into the ignition section by a movement of the ignition operating section toward the ignition position, and the introduction of fuel into the ignition section is prohibited by a movement of the ignition operating section away from the ignition position;

the movement restricting section has a movement restriction impelling section which applies an impelling force in such a manner that the movement restricting section moves along a direction from the holding section toward the permitting section;

the permitting section is an opening section which permits the ignition operating section to move from a position of separation from the movement restricting section to the ignition position; and the holding section side stopper section is a projecting section which projects in a direction from the position of separation toward the ignition position.

7. An igniter, comprising:

a nozzle section which emits a flame;

a fuel introduction section which introduces fuel; and an ignition section which ignites the introduced fuel, wherein the ignition section is configured in such a manner that the fuel is ignited by a movement of an ignition operating section, which is disposed on one side of the main body of the igniter, to an ignition position;

a movement restricting section having restricting sections which restrict the movement of the ignition operating section to the ignition position and a permitting section which permits said movement is disposed with respect to the ignition operating section;

the movement restricting section is configured in such a manner that by moving the movement restricting section, either the restricting sections or the permitting section can be located so as to correspond to a direction of movement of the ignition operating section;

a movement restricting section operating section which controls the movement of the movement restricting section is disposed on the main body of the igniter on a side opposite to the side where the ignition operating section is disposed, wherein the permitting section and the restricting sections of the movement restricting section are disposed so as to correspond to the direction of movement of the movement restricting section, the permitting section being disposed between respective restricting sections, and restricting section side stopper sections, which restrict the movement of the ignition operating section between the permitting section and the restricting sections, being formed in the boundary portions between the permitting section and the restricting sections, and, wherein the movement restricting section has a holding section for causing the ignition operating section to remain in the ignition position when the ignition operating section has been moved to the ignition position via the permitting section, and the holding section is formed adjacently to or in the vicinity of the permitting section along the direction of movement of the movement restricting section.

8. The igniter according to claim 7, wherein an ignition operation impelling section, which applies an impelling force to the ignition operating section in a direction which presses the ignition operating section against the holding section, is provided; and a holding section side stopper section which restricts the movement of the ignition operating section between the permitting section and the holding section is formed in the boundary portion between the permitting section and the holding section.

9. The igniter according to claim 8, wherein fuel is introduced into the ignition section by a movement of the ignition operating section toward the ignition position, and the introduction of fuel into the ignition section is prohibited by a movement of the ignition operating section away from the ignition position;

the movement restricting section has a movement restriction impelling section which applies an impelling force in such a manner that the movement restricting section moves along a direction from the holding section toward the permitting section;

the permitting section is an opening section which permits the ignition operating section to move from a position of separation from the movement restricting section to the ignition position; and the holding section side stopper section is a projecting section which projects in a direction from the position of separation toward the ignition position.

10. The igniter according to claim 7, wherein fuel is introduced into the ignition section by a movement of the ignition operating section toward the ignition position, and the introduction of fuel into the ignition section is prohibited by a movement of the ignition operating section away from the ignition position;

the movement restricting section has a movement restriction impelling section which applies an impelling force in such a manner that the movement restricting section moves along a direction from the holding section toward the permitting section;

the permitting section is an opening section which permits the ignition operating section to move from a position of separation from the movement restricting section to the ignition position; and the holding section side stopper section is a projecting section which projects in a direction from the position of separation toward the ignition position.

11. An igniter, comprising:

a nozzle section which emits a flame;

a fuel introduction section which introduces fuel; and an ignition section which ignites the introduced fuel, wherein the ignition section is configured in such a manner that the fuel is ignited by a movement of an ignition operating section, which is disposed on one side of the main body of the igniter, to an ignition position;

a movement restricting section having restricting sections which restrict the movement of the ignition operating section to the ignition position and a permitting section which permits said movement is disposed with respect to the ignition operating section;

the movement restricting section is configured in such a manner that by moving the movement restricting section, either the restricting sections or the permitting section can be located so as to correspond to a direction of movement of the ignition operating section;

a movement restricting section operating section which controls the movement of the movement restricting section is disposed on the main body of the igniter on a side opposite to the side where the ignition operating section is disposed, wherein the permitting section and the restricting sections of the movement restricting section are disposed so as to correspond to the direction of movement of the movement restricting section, the permitting section being disposed between respective restricting sections, and restricting section side stopper sections, which restrict the movement of the ignition operating section between the permitting section and the restricting sections, being formed in the boundary portions between the permitting section and the restricting sections, and wherein fuel is introduced into the ignition section by a movement of the ignition operating section toward the ignition position, and the introduction of fuel into the ignition section is prohibited by a movement of the ignition operating section away from the ignition position;

the movement restricting section has a movement restriction impelling section which applies an impelling force in such a manner that the movement restricting section moves along a direction from the holding section toward the permitting section;

the permitting section is an opening section which permits the ignition operating section to move from a position of separation from the movement restricting section to the ignition position; and the holding section side stopper section is a projecting section which projects in a direction from the position of separation toward the ignition position.

* * * * *